US006739946B1

(12) United States Patent
Chao et al.

(10) Patent No.: US 6,739,946 B1
(45) Date of Patent: May 25, 2004

(54) THERMAL-CHEMICAL POLISHING DEVICE AND METHOD THEREOF

(75) Inventors: Choung-Lii Chao, Hsinchu (TW); Kung-Jeng Ma, Hsinchu (TW); Hung-Yi Lin, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/444,979

(22) Filed: May 27, 2003

(30) Foreign Application Priority Data

Dec. 26, 2002 (TW) ..... 91137415 A

(51) Int. Cl.[7] ..... B24B 49/00; B24B 51/00

(52) U.S. Cl. ..... 451/7; 451/53; 451/218

(58) Field of Search ..... 451/7, 8, 6, 11, 451/28, 53, 212, 218, 394, 397, 398; 125/30.01

(56) References Cited

U.S. PATENT DOCUMENTS 3,568,368 A * 3/1971 Bwircman ..... 451/221

4,425,900 A * 1/1984 Bosschaert ..... 125/30.01

* cited by examiner

*Primary Examiner*—Hadi Shakeri
(74) *Attorney, Agent, or Firm*—Rabin & Berdo, P.C.

(57) ABSTRACT

A thermal-chemical polishing device and method for polishing a diamond film of a workpiece, the device includes a horizontally displaced first rotatable high rpm shaft and a vertically displaced second rotatable high rpm shaft that are perpendicular. The first shaft is made of a material from transition metals or rare-earth elements which undergo a chemical reaction with the diamond film at high temperature. The circumferential surface of the first shaft has a predefined heating region. The second shaft moves axially towards the first shaft to allow the diamond film to make contact with the heating region of the first shaft. A heating unit is provided to heat up the heating region to create a chemical reaction for thermal-chemical polishing to perform while the diamond film is in contact with the heating region. The device of the present invention increases the rate of polishing and also decreases cost.

20 Claims, 6 Drawing Sheets

Fig. 6A PRIOR ART

THERMAL-CHEMICAL POLISHING DEVICE AND METHOD THEREOF

FIELD OF THE INVENTION

The present invention is generally related to thermal-chemical polishing devices and methods suitable for diamond films, and more particularly to a high-speed and low-cost thermo-chemical polishing device and method for polishing diamond films.

BACKGROUND OF THE INVENTION

The technology in growing and depositing diamond films on substrates is constantly improving and has reached a level of maturity where diamond films are commonly used in different manufacturing industries. The deposition methods include PVD (physical vapor deposition) which generally forms a thinner layer of diamond film and different types of CVD (chemical vapor deposition) which generally form a thicker layer of diamond film. CVD depositions are divided into MPCVD, RF plasma CVD, HF CVD and thermal CVD which can under low pressure form a diamond film with a thickness up to several hundred micrometers on the surface of a workpiece. Due to its superior mechanical/optical properties such as high strength, low rate of wear, good heat conductivity, anti-radiation, high rate of electron transmission, and high corrosion resistance, the diamond film has infused into various industries creating a revolution of new applications.

A diamond-like carbon (DLC) formed by CVD for example can be used to form cutting tools (surface plating) or grinding powder due to its ultra high strength and good heat dissipating properties which can increase the cutting performance and at the same time extending its life span. Diamond films can also be applied to the surface of molds for protection which assists in heat dissipation (with an increase in the rate of heat dissipation 4 times that of silver) to allow better flow and release of the mold, as a result the life span of the mold increases between 2 to 10 times. Furthermore special properties of diamond films such as high electron transmission, high heat tolerance, anti-acid, and anti-radiation allow usage under extreme conditions such as in high temperature engines, and radar equipment. More importantly, diamond has been recently used as a semiconductor material where diamond chips have a transmission speed double that of silicon chips and yet are not handicapped by the operating temperature limit of 150° C. In MEMS components, diamond can eliminate the wear problem of silicon and can be used in high rpm components such as micro motors. At the same time, diamond has played an important role in the medical and optical field. Diamond is a suitable material to be implanted into a human body because of the high stiffness, low wear, and anti-corrosion properties. In the field of optics, diamond can produce highly transparent viewfinders, lenses, planar displays, and scanners. The introduction of diamond has lead to an increase in quality in various applications.

Regardless of the characteristic requirement of diamond for various applications, the level of surface planarity and smoothness has to meet stringent standard to prevent degradation of the superior properties of diamond such as high strength, low wear factor, and high transparency and retain the original performance of the material. Therefore in relation, the technique and technology in diamond polishing is the key to whether the use of diamond can be widely applicable in manufacturing. As commonly known, diamond has the highest hardness among all materials and therefore is usually used as a cutting tool or a polishing pad to polish other materials. In contrast, for diamond itself to be polished to reach planarity is very difficult. Furthermore diamond is a chemically inert material and is the only material that will not react with acid (also not with aqua regia) under 600° C. so it is extremely difficult to process diamond. In addition, the low wear and low coefficient of expansion contribute to the difficulty in processing diamond. Please refer to FIG. 5 showing an enlarged diagram of a workpiece 50 having a diamond film 50*a* being in contact with a polishing pad 55 during polishing. From the figure, due to the difference in the coefficient of expansion between the diamond film 50*a* and the substrate 50*b*, the higher coefficient of expansion of the substrate 50*b* will cause the workpiece 50 to experience warpage which prevents the planar polishing surface of the workpiece 50 from being perfectly in touch with the polishing pad 55. As a result, the quality of the polishing is unsatisfactory. The quality of the diamond polishing also depends on the film thickness, the substrate material, the forming temperature, and the polishing temperature which all affects the consistency of the quality.

Apart from warpage caused by differences in CTE (coefficient of thermal expansion), significant variation in film thickness may be introduced by the inhomogeneous distribution of plasma field (as shown in FIG. 5). In this aspect, a good level of planarity cannot be achieved without removing a large amount of material but contrarily removing a large amount of material requires a huge amount of time which is not time efficient. Consequently the technology for a diamond polishing device that allows high removal rate is in demand.

Diamond powder or diamond wheels are currently used to polish diamond films. However, the removal rate is extremely slow and the cost is high. Prior art uses a method by diffusion between diamond and transition metal (such as Fe) or rare-earth element (such as Se) at high temperature (above 500° C.) or by graphitization. The polishing pad is made of Fe or Ni—Se and the thermo-chemical polishing is performed at a temperature between 500° C. and 950° C. in an oxygen or hydrogen environment. FIGS. 6 and 6A show a conventional polishing machine 2. A heating device 61 is attached on a polishing pad 60 for increasing the temperature during polishing. A holder 62 is provided to secure a workpiece 63 by orienting the surface of the diamond film against the polishing pad 60 for performing thermal-chemical polishing. The polishing method used in prior art relies on the expensive and heavy heating device 61 which increases the cost of the polishing machine 2 and also at the same time decreases the performance of polishing due to the limitation on rotational speed of the polishing pad 60 from the added weight. For diamond films under 100 $\mu$m, it may take up to approximately 100 hours for the surface to achieve planarity together with extensive repair and replacement; therefore it is impractical for volume production and unsatisfactory to the industries. Furthermore, the conventional polishing machine 2 needs to be operated in a vacuum environment where after polishing a recover process is performed so an air tight mask 64 is provided on the periphery of the polishing pad 60. This design increases the cost of production and maintenance and also affects the rotational speed of the polishing pad 60. This conventional polishing machine 2 is uneconomical and cannot ameliorate the problem of warpage that is shown in FIG. 5 in order to maintain quality consistency.

Therefore the design of a thermal-chemical polishing machine that has a high polishing rate and at the same time low cost and easy to maintain which can satisfy economies of scale is the most focused area of research and development.

SUMMARY OF THE INVENTION

An object of the present invention is to provide a thermal-chemical polishing machine that has a high rate of polishing.

Another object of the present invention is to provide a thermal-chemical polishing machine that is low in cost.

Another object of the present invention is to provide a thermal-chemical polishing machine that is easy to repair and replace.

In meeting the aforementioned objects, the present invention provides a thermal-chemical polishing device and method thereof, comprising: a high rpm first rotatable shaft with a circumferential surface having a material that can react with diamond at high temperature and having a predefined heating region; a high rpm rotatable and translational second shaft which is coupled in perpendicular to the first rotatable shaft; and a heating unit that is used to heat up the heating region on the circumferential surface of the first shaft. The second shaft engages with the first shaft to allow the workpiece having the diamond film in the holder to make contact with the heating region. As the diamond film of the workpiece makes contact with the material on the circumferential surface of the first shaft, a chemical reaction occurs for performing a thermal-chemical polish.

The present invention provides a method of thermal-chemical polishing used in the above-mentioned thermal-chemical device, the method comprising the following steps: initiate high rpm rotation of the first shaft; heat up the heating region on the circumferential surface of the first shaft by the heating unit; initiate high rpm rotation of the second shaft and move in the direction of the axis of rotation to allow the diamond film of the workpiece to make contact with the predefined heating region on the first shaft for performing a thermal-chemical polishing. During the polishing process, the second shaft moves axially in a suitable feed-in rate to maintain the surface of the diamond film in appropriate contact with the heating region and to terminate the polishing process as long as the diamond film reaches a level of accepted planarity.

The material of the first shaft that provides the chemical reaction with the diamond is a transition metal (such as Fe) or a rare-earth element (such as Se), which reduces the material cost and increases rotational speed by making the first shaft into a hollow shaft or plating with a transition metal or rare-earth elements onto the surface of the first shaft which can made of a lighter material. Moreover the heating device can be an infrared type or an inductance type which can heat up the predefined heating region to above 450° C. for allowing a chemical reaction to take place between the diamond and the transition metals or the rare-earth elements; the second shaft moves back and forth along a direction perpendicular to the first shaft during polishing to allow sliding contact with the heating region of the first shaft to prevent the thickness of one particular area of the surface in the predefined heating region eroding too quickly.

Furthermore a sensing device is located on the second shaft for detecting the positive cutting force exerted or the surface thickness of the circumferential surface of the predefined heating region during polishing. The sensing device adjusts the feed-in according to the result of the detection so the level of contact between the surface of the diamond film and the predefined heating region is maintained at an appropriate level for controlling the quality and efficiency of the polishing process.

According to the above, the present invention provides a thermal-chemical polishing device and a method thereof which uses special devices to greatly increase the rate of polishing. At the same time, the number of components decreases so no extra weight is added to the polishing shaft that causes a decrease in the rotational speed. Furthermore the cost is lowered because there is no wastage of material and lastly repair and maintenance are easy to improve efficiency.

BRIEF DESCRIPTION OF THE DRAWINGS

The present invention can be more fully understood by reading the following detailed description of the preferred embodiments, with reference made to the accompanying drawings, wherein:

FIGS. 6 and 6A are schematic views of a conventional thermal-chemical polishing device.

DETAILED DESCRIPTION OF THE PREFERRED EMBODIMENTS

Figure 1:
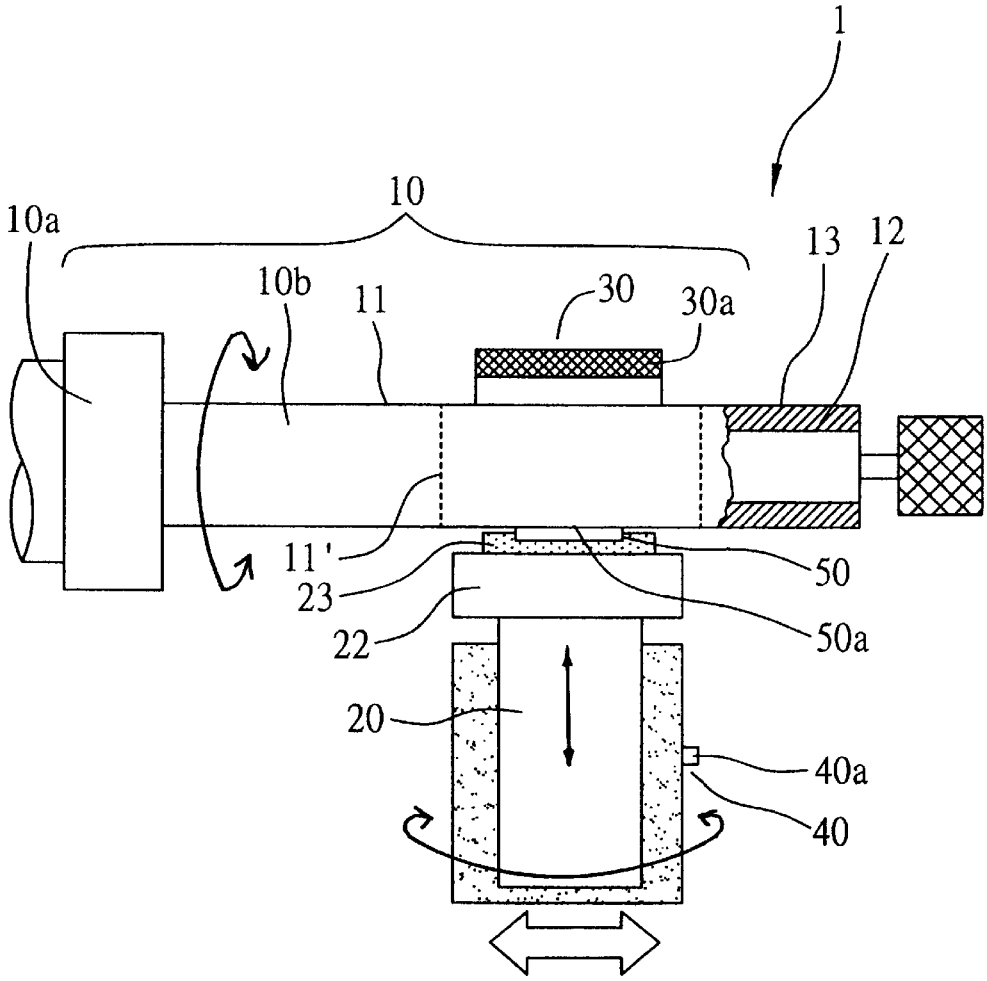
FIG. 1 is a schematic side view of the thermal-chemical polishing device of the present invention according the first embodiment.

The diamond film thermal-chemical polishing device 1 of the present invention is illustrated in FIG. 1. The device 1 comprises a polishing shaft 10, a workpiece shaft 20, a heating unit 30, a sensing unit 40. The polishing shaft 10 is perpendicular to the vertical workpiece shaft 20 and the polishing shaft 10 lies horizontally. A main shaft mount 10*a* allows high rpm rotation. A metal polishing axle 10*b* sits on the main shaft mount 10*a* for reducing the material cost and weight and for increasing the rotational speed of the polishing shaft 10. The metal polishing axle 10*b* is the only hollow shaft that is made out of a light metal 12. The circumferential surface 11, as illustrated in the figure, is plated with a transition metal such as Fe, Ti, V, Cr, Mn, Ni, Co or the like of a certain thickness (Fe is the abundantly used material). The rare-earth element such as Se, Te, Y or the like can also be used. The circumferential surface 11 has a predefined heating region 11' which is the area of the polishing shaft 10 set for polishing. The width of the heating region 11' can be adjusted according to the user or to the heating unit 30 to meet different polishing requirements. Furthermore the thickness of the plating of the material 13 of the circumferential surface 11 needs to be even and preferably having identical thickness or at least the surface thickness of the heating region 11' of the polishing shaft 10 has to be the same in order to meet the precise requirement of polishing. The workpiece shaft 20 being perpendicular to the polishing shaft 10 is used to carry the workpiece 50 having a diamond film that is to be polished. The top surface of the workpiece shaft 20 has a holding platform 22 where the holding platform 22 has a holding mount 23 for providing contact with the heating region 11' of the polishing shaft 10. The workpiece 50 having a diamond film sits on the holding mount 23 while polishing is performed by the feed-in of the holding mount 23 by the workpiece shaft 20 to make contact with the circumferential surface 11 of the polishing shaft 10 under high rpm rotation. Furthermore the workpiece shaft 20 performs three kinds of movement here one is a high rpm rotational movement, the other is a translational back and forth movement (the axial direction of the polishing shaft 10), and the last is in the feed-in direction. The feed-in direction movement allows contact with the predefined heating region 11' by controlling the amount of feed-in. The surface material 13 of the predefined heating region 11' is consumed by the chemical reaction during the polishing process so the surface thickness gradually decreases. At the same time, the workpiece shaft 20 feeds in the workpiece 50 having a diamond film 50*a* to make consistent contact with the material 13 of the heating region 11' to continue the diamond polishing and removing process. During the polishing process, the workpiece shaft 20 continues to feed in upwards by an appropriate amount which is controlled and monitored by the sensing unit 40 located on the workpiece shaft 20. The translational movement of the workpiece shaft 20 also allows the workpiece shaft 20 to make contact with the predefined heating region 11' in a back and forth manner so the sliding movement of the workpiece 50 stays within the heating region 11' to generate an averaged polishing. If the workpiece 50 only stays within one fixed spot within the heating region 11', the surface thickness of the fixed spot will erode too quickly. The workpiece shaft 20 and the polishing shaft 10 rotate simultaneously so when the diamond film being rotated by the workpiece shaft 20 meets the rotating polishing shaft 10, the polishing rate increases. The translational back and forth (as seen as left and right movement in the diagram) movement of the workpiece shaft 20 is set within the heating region 11' and the speed of the translational movement needs not to be too fast so to maintain a high-efficiency average removal rate of the diamond film 50*a*.

The heating unit 30 disposed in the heating region 11' of the polishing shaft 10 is an infrared heating unit 30*a* in this embodiment. The infrared heating unit 30*a* is disposed on the circumferential surface of the heating region 11' but is not in contact with the polishing shaft 10 to prevent the decrease in rpm of the polishing shaft 10. The heating unit 30*a* is responsible for increasing the temperature of the heating region to a range from 450° C. to 950° C. When the temperature of the material 13 (a transition metals or rare-earth metal) on the circumferential surface 11 reaches 450° C., the thermal-chemical polishing of the diamond film starts (the temperature of the diamond film increases accordingly). As the temperature increases, the rate of polishing increases proportionally. As previously mentioned, the sensing unit 40 is located on the workpiece shaft 20 to control the feed-in according to the results of the detection. The sensing unit 40 is a cutting dynamometer 40*a* and it detects and receives the cutting force signal of the workpiece 50 to monitor and regulate the cutting force of the workpiece 50 during polishing to prevent uneven polishing due to no engagement with the workpiece shaft 20 causing temporary stops of the polishing process. The workpiece shaft 20 provides a proper amount of feed in the upward direction based on the amount of cutting force received from the sensing unit 40*a* so the positive cutting force exerted by the workpiece shaft 20 is maintained at the default level for performing polishing. Furthermore the results obtained from the sensing unit 40*a* or other sensing devices can be used to establish an end-point detection system for properly terminating the polishing process once the surface thickness and its consistency of the diamond film has reached the predetermined level.

Figure 2:
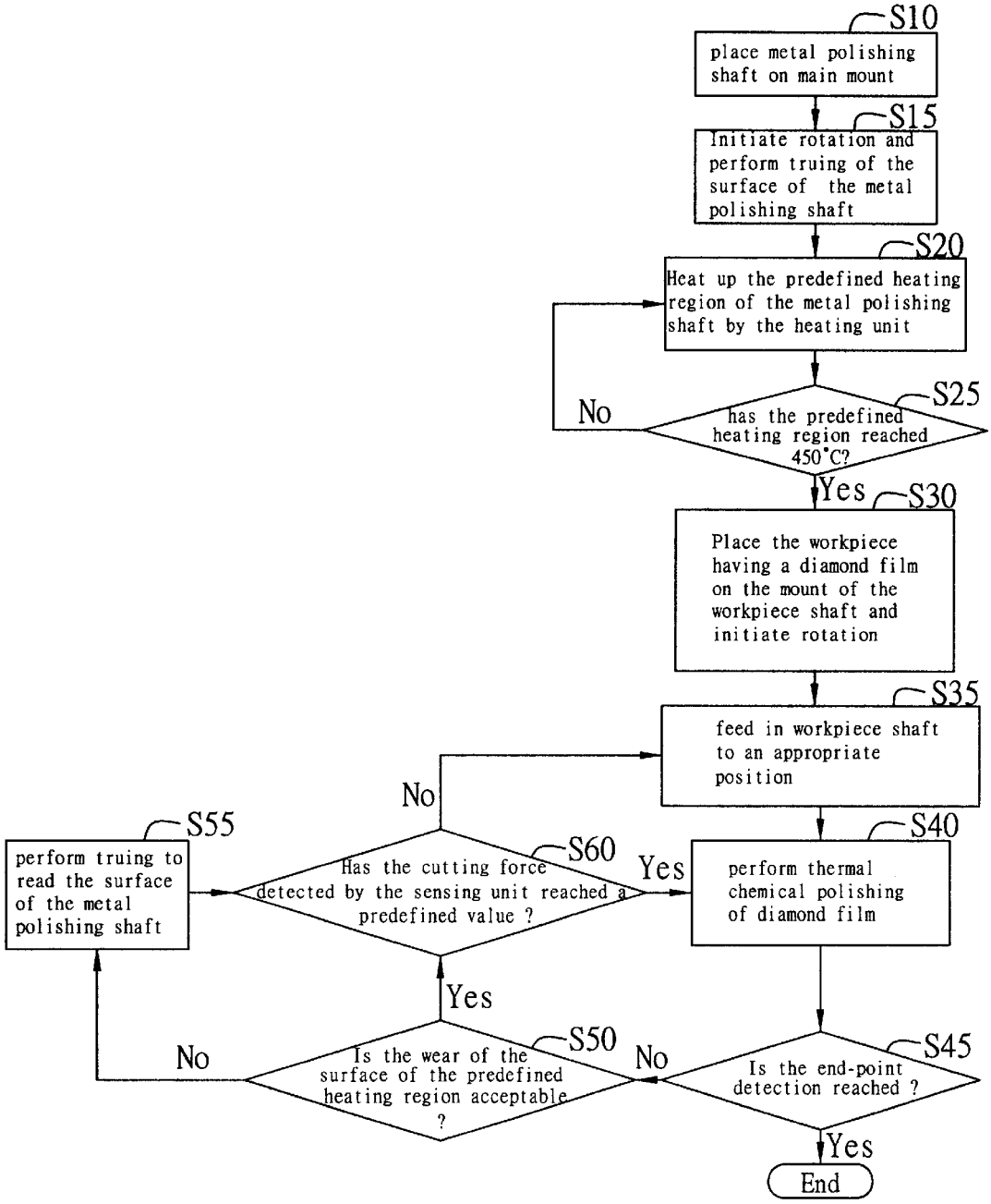
FIG. 2 is a flow chart of the thermal-chemical polishing method.

FIG. 2 is a flow chart showing the method of thermal-chemical polishing of the present invention based on the above embodiment. The polishing process starts off by step S10 in which a metal polishing shaft plated with a transition metal or rare-earth element is placed on a main driving source which allows high rpm rotation where the polishing shaft is driven by the main driving source to high rpm rotation. Following in step S15, the main driving source starts to rotate at high rpm to perform truing of the circumferential surface of the polishing shaft. This step is important in preventing the polishing shaft from being uneven or not true which affects the quality of polishing of the diamond film. When the surface trueness reaches the level of acceptance, the flow moves to step S20. In step S20, a heating unit (such as an infrared heating unit) increases the temperature of the predefined heating region of the metal polishing shaft where the heat is evenly spread out by the high rpm rotational movement of the polishing shaft. Step S25 is a 2-way decide module to determine if the heating region has reached a temperature of above 450° C. to ensure quality not degraded due to insufficient heating. In step S30, the to-be-processed workpiece is placed on the workpiece shaft which is perpendicular to the polishing shaft. The workpiece sits on a holding mount on a holding platform with the side having the diamond film facing upwards against the polishing shaft. At last the workpiece shaft is driven to high rpm rotation. In step S35, the workpiece shaft is fed in a certain amount into the polishing shaft causing the diamond film and the heating region to generate a predetermined level of contact. Following in step S40, the thermal-chemical polishing process starts with the following implementation. The high rpm rotation of the polishing shaft and the workpiece shaft together with the high-temperature chemical reaction are complemented by the back and forth translational movement of the workpiece shaft along the polishing shaft to increase the rate of polishing during the chemical reaction. In step S45, the sensing unit located on the workpiece shaft determines if the end-point has reached which indicates that the level of planarity of the diamond film has reached the required level. If the result is 'yes' the polishing process is completed, and if the result is 'no' the polishing process continues until the level of planarity of the diamond film reaches the required level. The precision of the thermal-chemical polishing method of the present invention is adjusted during the polishing process by determining (from the sensing unit) if the erosion of the material on the predefined heating region is too much (the chemical reaction with diamond). If the erosion is too much, the quality or efficiency of polishing will be affected (outside the acceptable region) and step S55 is performed to repair the surface of the polishing shaft by truing and then proceed to step S60. Oppositely if the wear level is within a tolerable range, no repair is performed and the flow directly proceeds to step S60. S60 is a 2-way decide module to determine if the cutting force detected by the sensing unit has reached the predefined level. If the detected cutting force is too low the material in the predefined heating region must have experienced a certain level of wear and therefore the feed-in from the workpiece shaft is therefore not sufficient. The flow reverts back to step S35 to generate a new amount of feed-in for the workpiece shaft to resume the polishing process at the predefined cutting force. The new feed-in rate can be calculated and controlled by the sensing unit. By means of this precise control method, the diamond film of the workpiece is polished under a high quality and efficiency system until in step S45 where the predefined end-point has reached. The aforementioned describes the operation of the method of polishing diamond film according to this embodiment.

Figure 3:
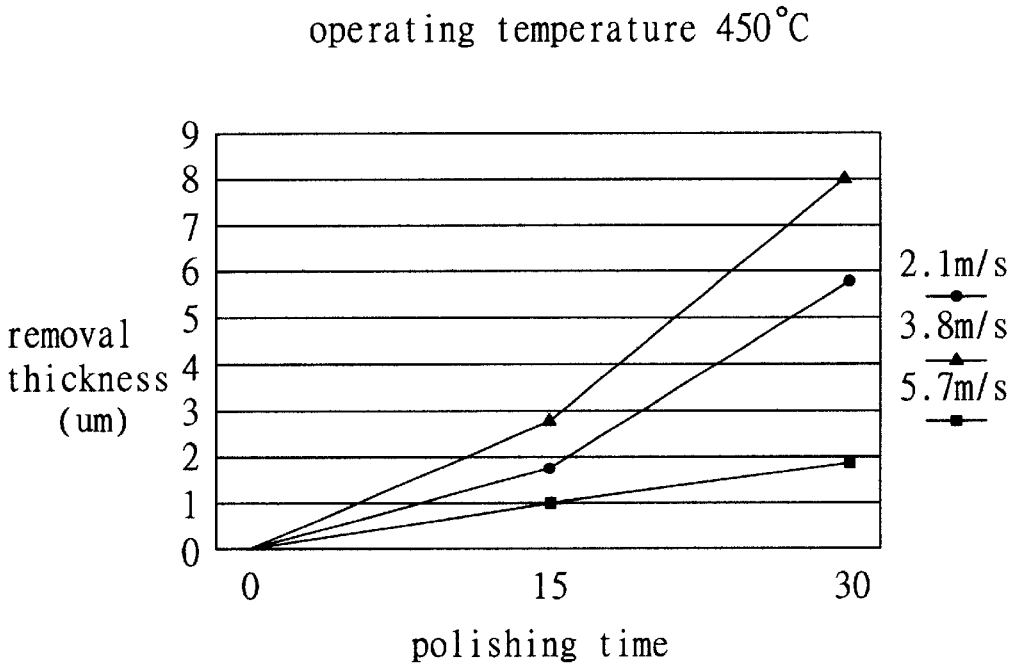
FIG. 3 is a chart of experimental results showing the rate of polishing.

The thermal-chemical polishing device and method thereof of the present invention can effectively improve the shortcomings such as the low rate of polishing in prior art. FIG. 3 shows results of an experiment performed according to the above embodiment. The experiment is performed at a temperature of approximately 450° C. which indicates the temperature at the heating region raised by the heating unit. The chart in FIG. 3 is thickness in $\mu$m vs. polishing time with 3 curves showing the experiment carried out in different tangential velocities in m/s. The thermal-chemical polishing method of the present invention greatly improves the rate of polishing over prior art which needs over 100 hours. The experimental results come as expected when the rpm increases the rate of polishing increases accordingly.

Figure 4:
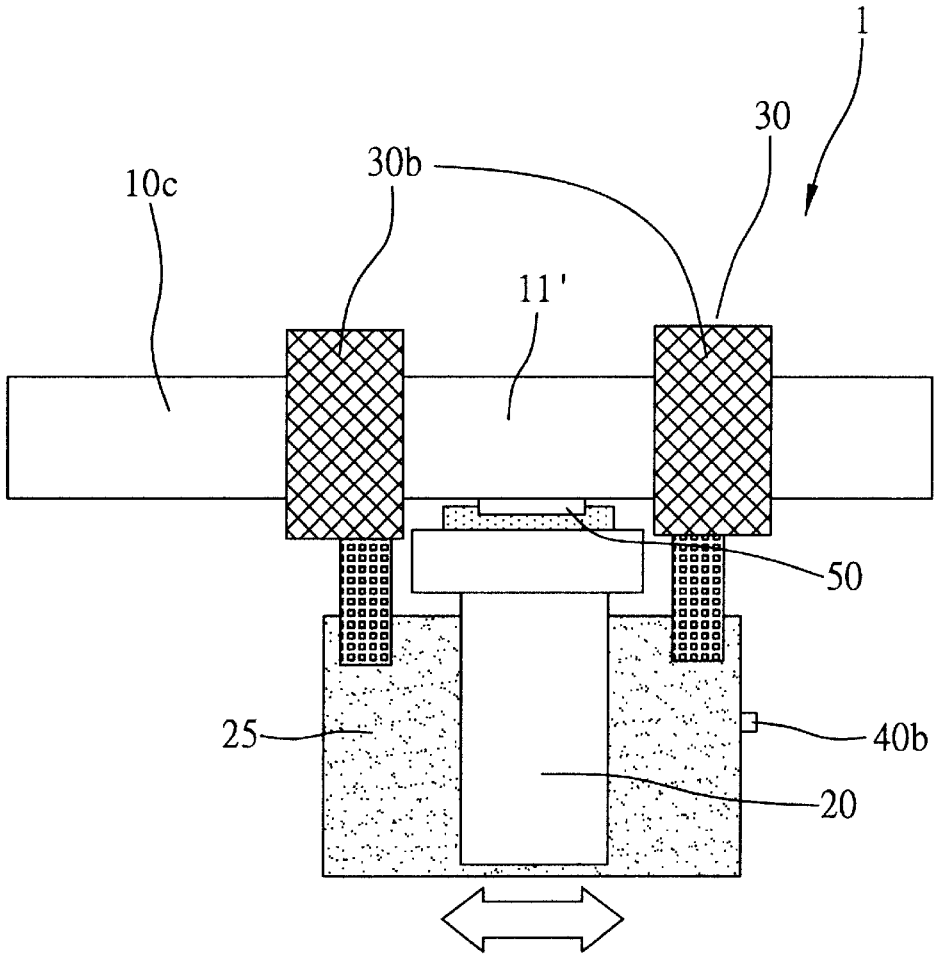
FIG. 4 is a schematic side view of the thermal-chemical polishing device of the present invention according to the second embodiment.
Figure 5:
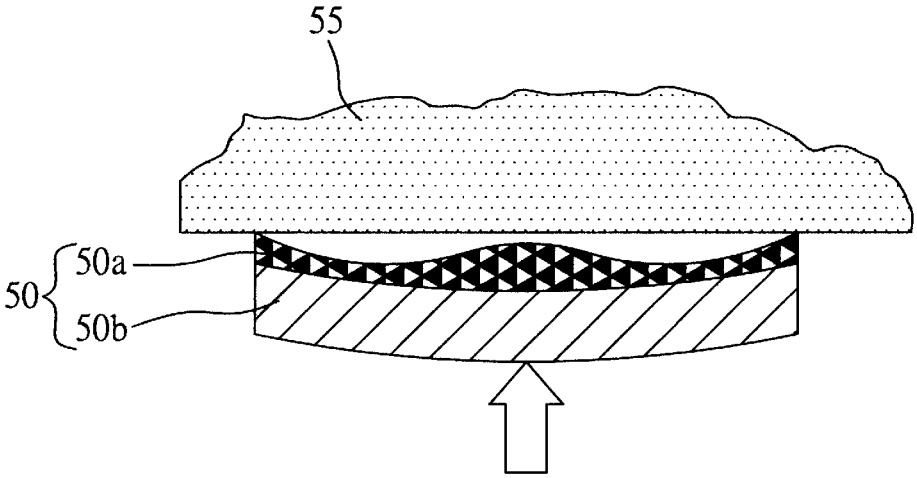
FIG. 5 is an exploded view showing the diamond film during the polishing process.
Figure 6:
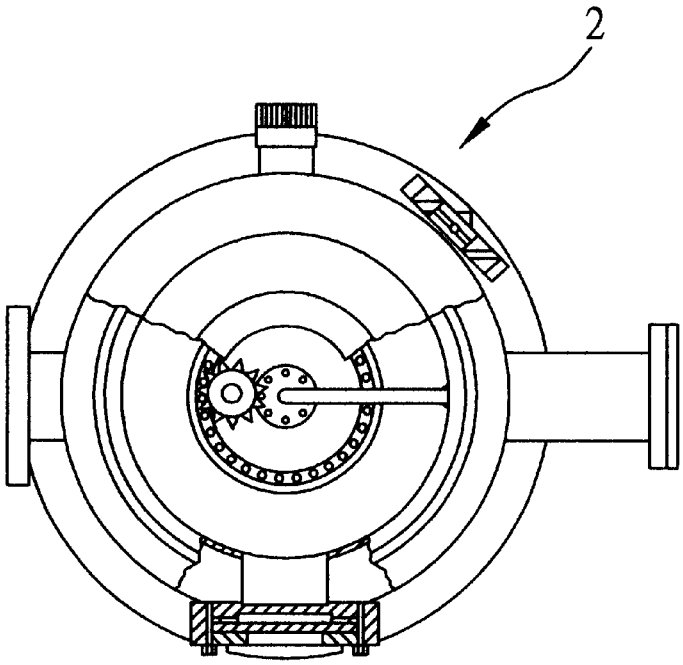
Fig. 6 (Prior art)
Figure 6:
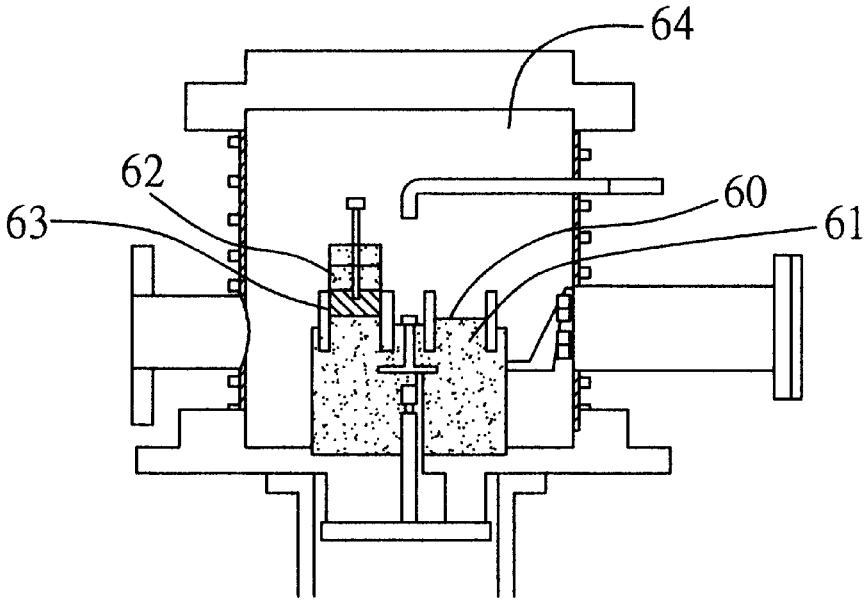
Fig. 6 (Prior art)

Furthermore the thermal-chemical polishing device 1 of the present invention does not limit the components such as the polishing shaft 10, the heating unit 30, and the sensing unit 40 to those mentioned in the above embodiment. FIG. 4 shows another embodiment of the thermal-chemical polishing device which represents the second embodiment of the present invention. The polishing shaft is a solid shaft 10*c* in this embodiment which is entirely made of transition metals (such as Fe) or rare-earth element substance (such as Se). The heating unit 30 is an inductance heater 30*b* located on the two ends of the workpiece shaft platform 25 which can move back and forth horizontally along a left and right direction in the diagram and can also move back and forth vertically towards the polishing shaft 10*c* to make contact with the heating region 11' (the temperature of the diamond film at the same time increases). Moreover the workpiece shaft 20 is under high rpm rotation within the workpiece shaft platform 25 which together with the translational back and forth movement of the workpiece platform 25 itself generates a sliding back and forth contact between the diamond film of the workpiece 50 and the predefined heating region 11' to prevent a fixed area of the polishing shaft 10*c* being overly removed.

Furthermore the sensing unit 40 in the second embodiment is a displacement sensor 40*b* which detects the surface thickness of the heating region 11' of the solid polishing shaft 10*c* and does not detect the positive cutting force during the polishing process of the diamond film. The operator can calculate the feed-in of the workpiece shaft 20 by determining the level of material wear from the heating region 11' of the polishing shaft 10*c*. However the surface thickness is not uniform within the entire heating region 11' so the location of the sensing unit 40*b* makes a significant difference to the result. Overall the precision of the displacement sensing method is not as good as the cutting force method. The operation of the second embodiment is identical to that of the first with only difference in the heating unit and the sensing unit. The heating unit and sensing unit are replaced by the heating unit 30*b* and the sensing unit 40*b*. Please refer to the flow chart in FIG. 2 for the operation of the thermal-chemical polishing therefore it will not be repeated in writing.

Summarizing the above, the thermal-chemical polishing device and method of the present invention can effectively increase the rate of polishing and at the same time is simple with minimal number of components which lowers cost. The repair and maintenance cost are kept low because there is no need to frequently replace the material even under high volume of polishing. The unsolved problems of conventional polishing devices are improved by the present invention.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A thermal-chemical polishing device suitable for polishing a diamond film on a workpiece, the device comprising:

a first rotatable shaft with a circumferential surface having a material that is chemically reactive with diamond at a high temperature;

a second rotatable shaft movable along an axial direction and is axially perpendicular to the first rotatable shaft, wherein an end of the second rotatable shaft has a holding mount for holding the workpiece having the diamond film; and a heating unit for heating up the circumferential surface of the first rotatable shaft, wherein when the second rotatable shaft moves towards the first rotatable shaft in the axial direction, the diamond film of the workpiece on the holding mount comes into contact with the circumferential surface of the first rotatable shaft to induce a chemical reaction.

2. The thermal-chemical polishing device of claim 1, wherein the material is selected from a group consisting of transition metal and rare-earth element.

3. The thermal-chemical polishing device of claim 1, wherein the first rotatable shaft is a solid shaft plated with transition metals and rare-earth elements at least on the circumferential surface thereof.

4. The thermal-chemical polishing device of claim 1, wherein the first rotatable shaft is a hollow shaft plated with transition metals and rare-earth elements at least on the circumferential surface thereof.

5. The thermal-chemical polishing device of claim 1, wherein a sensing unit is provided on the second rotatable shaft for detecting a polish result of the diamond film so as to determine a feed-in rate of the axial movement of the second rotatable shaft, and the detected polish result is a positive cutting force exerted on the diamond film during polishing.

6. The thermal-chemical polishing device of claim 1, wherein a sensing unit is provided on the second rotatable shaft for detecting a polish result of the diamond film so as to determine a feed-in rate of the axial movement of the second rotatable shaft, and the detected polish result is a thickness of the circumferential surface of the first rotatable shaft during polishing.

7. The thermal-chemical polishing device of claim 1, wherein during thermal-chemical polishing, the second rotatable shaft simultaneously rotates and moves back and forth along an axial direction of the first rotatable shaft and within a predefined heating region of the first rotatable shaft, so as to prevent over cutting of any particular surface area within the heating region.

8. The thermal-chemical polishing device of claim 7, wherein the heating unit heats the heating region of the first rotatable shaft to a temperature of above 450° C.

9. The thermal-chemical polishing device of claim 8, wherein the heating unit is an infrared heating unit.

10. The thermal-chemical polishing device of claim 8, wherein the heating unit is an induction-type heating unit.

11. A thermal-chemical polishing method, comprising:

providing a thermal chemical polishing the device comprising a first rotatable shaft, a second rotatable shaft that is perpendicular to the first rotatable shaft, and a heating unit for heating up a predefined heating region on the first rotatable shaft, a circumferential surface of the first rotatable shaft having a material that is chemically reactive with diamond at a high temperature, and the second rotatable shaft having a workpiece mounted thereon, the workpiece having a diamond film to be polished;

rotating the first rotatable shaft rotate and heating the predefined heating region on the first rotatable shaft to a high temperature using the heating unit;

rotating the second rotatable shaft and moving the second rotatable shaft in a translational direction to make the diamond film of the workpiece come into contact with the heating region on the first rotatable shaft to induce a chemical reaction for performing a thermal-chemical polish;

during polishing, moving the second rotatable shaft in the translational direction and at a suitable feed-in rate to maintain appropriate contact between the diamond film and the heating region; and completing polishing when the diamond film is polished to have acceptable surface smoothness.

12. The thermal-chemical polishing method of claim 11, wherein the material is selected from the group consisting of transition metal and rare-earth element.

13. The thermal-chemical polishing method of claim 11, wherein the first rotatable shaft is a solid shaft plated with transition metals and rare-earth elements at least on the circumferential surface thereof.

14. The thermal-chemical polishing method of claim 11, wherein the first rotatable shaft is a hollow shaft plated with transition metals and rare-earth elements at least on the circumferential surface thereof.

15. The thermal-chemical polishing method of claim 11, wherein the feed-in rate of the second rotatable shaft is deduced from a polish result of the diamond film detected by a sensing unit provided on the second rotatable shaft, and the detected polish result is a positive cutting force exerted on the diamond film during polishing.

16. The thermal-chemical polishing method of claim 11, wherein the feed-in rate of the second rotatable shaft is deduced from a polish result of the diamond film detected by a sensing unit provided on the second rotatable shaft, and the detected polish result is a thickness of the circumferential surface of the first rotatable shaft during polishing.

17. The thermal-chemical polishing method of claim 11, wherein during thermal-chemical polishing, the second rotatable shaft simultaneously rotates and moves back and forth along an axial direction of the first rotatable shaft and within the predefined heating region so as to prevent over cutting of any particular surface area within the heating region.

18. The thermal-chemical polishing method of claim 11, wherein the heating unit heats the heating region of the first rotatable shaft to a temperature of above 450° C.

19. The thermal-chemical polishing method of claim 18, wherein the heating unit is an infrared heating unit.

20. The thermal-chemical polishing method of claim 18, wherein the heating unit is an induction-type heating unit.

* * * * *